US009086259B2

(12) United States Patent
Cleveland et al.

(10) Patent No.: US 9,086,259 B2
(45) Date of Patent: Jul. 21, 2015

(54) APPARATUS FOR DEPLOYING STOWED CONTROL SURFACES OF A PROJECTILE

(75) Inventors: Kenneth Cleveland, Hollis, NH (US); Amy Pietrzak, Londonderry, NH (US); Adam Butland, Hudson, NH (US); James H. Steenson, Jr., New Boston, NH (US); David Schorr, Austin, TX (US); Joseph Borysthen-Tkacz, Essex, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 13/885,580

(22) PCT Filed: Aug. 17, 2012

(86) PCT No.: PCT/US2012/051261

§ 371 (c)(1),
(2), (4) Date: May 15, 2013

(87) PCT Pub. No.: WO2013/066478

PCT Pub. Date: May 10, 2013

(65) Prior Publication Data

US 2014/0060370 A1 Mar. 6, 2014

Related U.S. Application Data

(60) Provisional application No. 61/527,756, filed on Aug. 26, 2011.

(51) Int. Cl.
*F42B 10/64* (2006.01)
*F42B 10/20* (2006.01)

(52) U.S. Cl.
CPC ..... *F42B 10/20* (2013.01); *F42B 10/64* (2013.01)

(58) Field of Classification Search
CPC ..... F42B 15/01; F42B 10/64; F42B 10/14; F42B 10/20; F42B 10/06
USPC ..... 244/3.21, 3.24, 3.22, 3.26, 3.27, 172.6, 244/49, 3.28
See application file for complete search history.

(56) References Cited

U.S. PATENT DOCUMENTS 3,047,259 A * 7/1962 Tatnall et al. ..... 244/138 A
3,830,214 A 8/1974 Curtis (Continued)

FOREIGN PATENT DOCUMENTS

FR 2980842 A1 * 4/2013 ..... F42B 10/20
WO WO2012/003025 1/2012
WO WO 2012170659 A1 * 12/2012 ..... F41F 3/077

OTHER PUBLICATIONS

PCT/US2012/051261 International Search Report mailed Apr. 19, 2013.

*Primary Examiner* — Benjamin P Lee
(74) *Attorney, Agent, or Firm* — Antony Ng; Daniel J. Long

(57) ABSTRACT

An apparatus for deploying stowed control surfaces of a projectile is disclosed. The apparatus for deploying stowed control surfaces of a projectile includes a first and second hot gas generators, a first and second gas chambers, a piston wedge, a piston and a barrel. Initially, the first hot gas generator discharges a surge of hot gas into the first gas chamber. In response to the surge of hot gas being discharged into the first gas generator, the piston wedge displaces at least one of the control surfaces to break an environmental seal covering the projectile. After a predetermined amount of time has lapsed, the second hot gas generator discharges a surge of hot gas into the second gas chamber. The surge of hot gas displaces the piston and barrel for deploying the control surfaces completely.

7 Claims, 5 Drawing Sheets

(56) References Cited

U.S. PATENT DOCUMENTS

| | | | | |
|---|---|---|---|---|
| 4,332,360 | A * | 6/1982 | Topliffe | 244/3.27 |
| 4,685,377 | A | 8/1987 | Mace et al. | |
| 5,192,037 | A * | 3/1993 | Moorefield | 244/46 |
| 6,446,906 | B1 * | 9/2002 | Voigt et al. | 244/3.27 |
| 6,672,536 | B2 | 1/2004 | Bar et al. | |
| 6,695,252 | B1 * | 2/2004 | Dryer | 244/3.28 |
| 6,880,780 | B1 * | 4/2005 | Perry et al. | 244/3.27 |
| 7,829,830 | B1 * | 11/2010 | Rogers | 244/3.27 |
| 8,304,703 | B2 * | 11/2012 | Hong et al. | 244/3.27 |
| 8,610,042 | B2 * | 12/2013 | Sankovic | 244/3.24 |
| 8,716,640 | B2 * | 5/2014 | Baras et al. | 244/3.27 |
| 8,895,908 | B2 * | 11/2014 | Barry et al. | 244/3.27 |
| 2002/0117580 | A1 | 8/2002 | Rupert et al. | |
| 2011/0186678 | A1 * | 8/2011 | Sankovic | 244/3.27 |
| 2013/0206897 | A1 * | 8/2013 | Rastegar et al. | 244/3.24 |
| 2013/0277494 | A1 * | 10/2013 | Rastegar et al. | 244/3.24 |

* cited by examiner

APPARATUS FOR DEPLOYING STOWED CONTROL SURFACES OF A PROJECTILE

PRIORITY CLAIM

The present application claims priority under 35 U.S.C. 119(e)(1) to provisional application No. 61/527,756 filed on Aug. 26, 2011, the contents of which are incorporated herein by reference.

BACKGROUND OF THE INVENTION

1. Technical Field

The present invention relates to projectiles in general, and in particular to an apparatus for deploying stowed control surfaces of a projectile.

2. Description of Related Art

Control surfaces, commonly known as wings or fins, ensure that a projectile can fly along any path to which it is directed. For an unguided projectile, control surfaces keep the projectile on a straight-line flight path to an intended target. For a guided projectile, such as a heat-seeking missile, control surfaces provide the requisite maneuverability for tracking targets and help to stabilize the projectile along a flight path after maneuvers have been completed.

Control surfaces are preferably designed to be folded within the body of a projectile until the projectile has been launched from a launch platform. Folded control surfaces allow for space-efficient storage and the usage of a simple "tube-launch" system on the launch platform.

The original method of deploying folded control surfaces from within a projectile simply relies on the centripetal force generated by rotational spinning of the projectile. In recent years, environmental seals were introduced to protect projectiles from corrosion, foreign object damage, and other environmental risks. For projectiles having environmental seals, centripetal force alone is generally not sufficient to overcome the resistance of the environmental seals for properly deploying control surfaces. Control surfaces deployment systems intended for a projectile having environmental seals must exert enough energy in order to overcome the resistance created by environmental seals surrounding the projectile as well as powerful aerodynamic or fluid-dynamic loads.

Spring-based control surfaces deployment mechanisms have been utilized to overcome the initial resistance for breaking environmental seals of a projectile. Spring-based control surfaces deployment mechanisms are effective for large diameter projectiles having thin environmental seals launched at low speeds. However, spring-based control surfaces deployment mechanisms tend to be relatively heavy and have a low-energy density, both of which are undesirable for any airborne applications. Furthermore, spring-based control surfaces deployment mechanisms are typically not effective for small diameter projectiles having more resistive environmental seals.

Consequently, it would be desirable to provide an improved deployment system capable of deploying control surfaces of a projectile.

SUMMARY OF THE INVENTION

In accordance with a preferred embodiment of the present invention, an apparatus for deploying stowed control surfaces of a projectile includes a first and second hot gas generators, a first and second gas chambers, a piston wedge, a piston and a barrel. Initially, the first hot gas generator discharges a surge of hot gas into the first gas chamber. In response to the surge of hot gas being discharged into the first gas generator, the piston wedge displaces at least one of the control surfaces to break an environmental seal covering the projectile. After a predetermined amount of time has lapsed, the second hot gas generator discharges a surge of hot gas into the second gas chamber. The surge of hot gas displaces the piston and barrel for deploying the control surfaces completely.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1A:
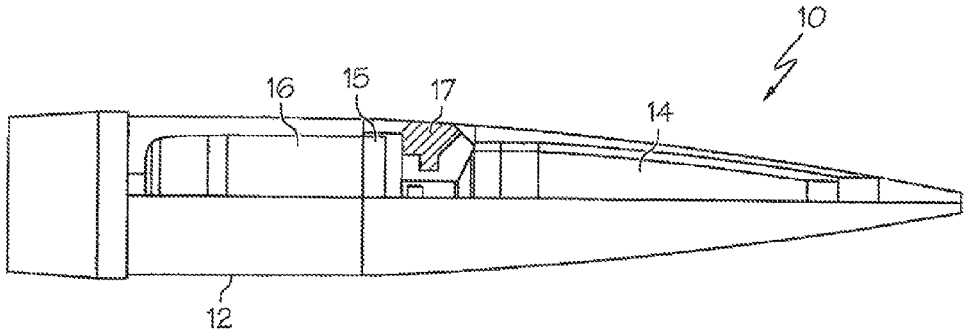
FIGS. 1A-1B are cross-sectional views of a projectile in which a preferred embodiment of the present invention can be incorporated.
Figure 1B:
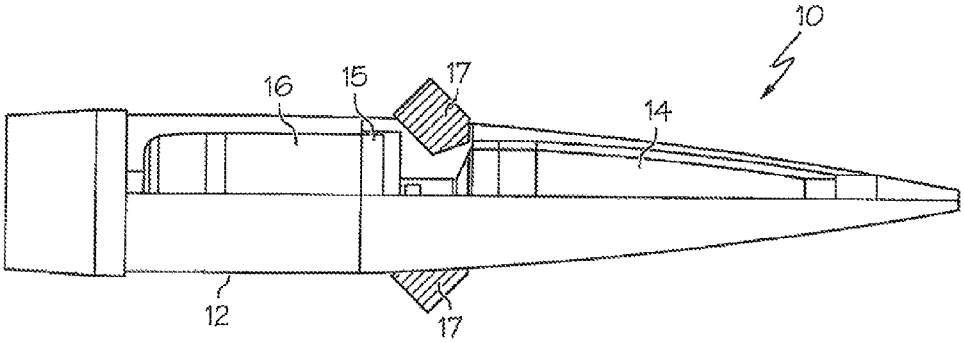

Referring now to the drawings and in particular to FIGS. 1A-1B, there are illustrated cross-sectional views of a projectile in which a preferred embodiment of the present invention can be incorporated. As shown, a projectile 10 includes a body 12 that houses a war head 14, a guidance system 15, and a rocket motor 16. Rocket motor 16 allows the range of projectile 10 to be extended by boosting projectile 10 to a higher velocity. Projectile 10 also includes a set of control surfaces such as fins 17 that can be stowed within body 12. FIG. 1A shows projectile 10 having its fins 17 in a stowed position. FIG. 2B shows projectile 10 having its fins 17 in a deployed position.

For safety reasons, the surface of projectile 10 is preferably covered and protected by an environmental seal. In order to deploy fins 17, fins 17 have to be able to break the environmental seal. In accordance with a preferred embodiment of the present invention, a seal-breaching element is utilized to assist fins 17 to break the environmental seal.

Figure 2A:
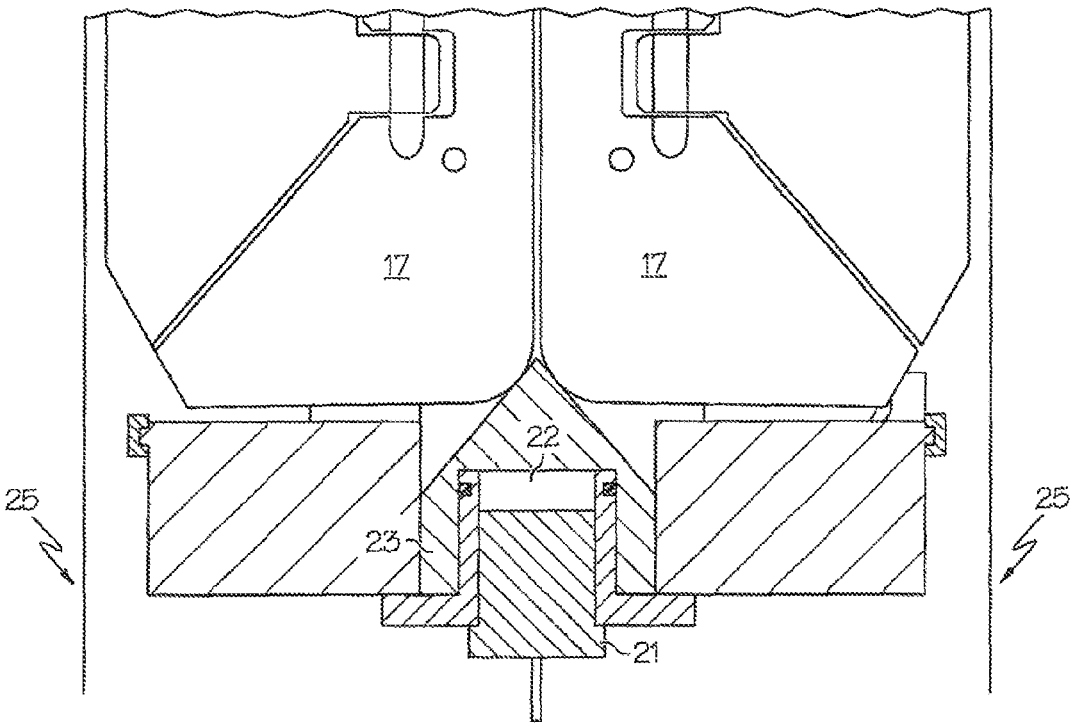
FIGS. 2A-2B show a seal-breaching element of the projectile from FIG. 1A, in accordance with a preferred embodiment of the present invention.
Figure 2B:
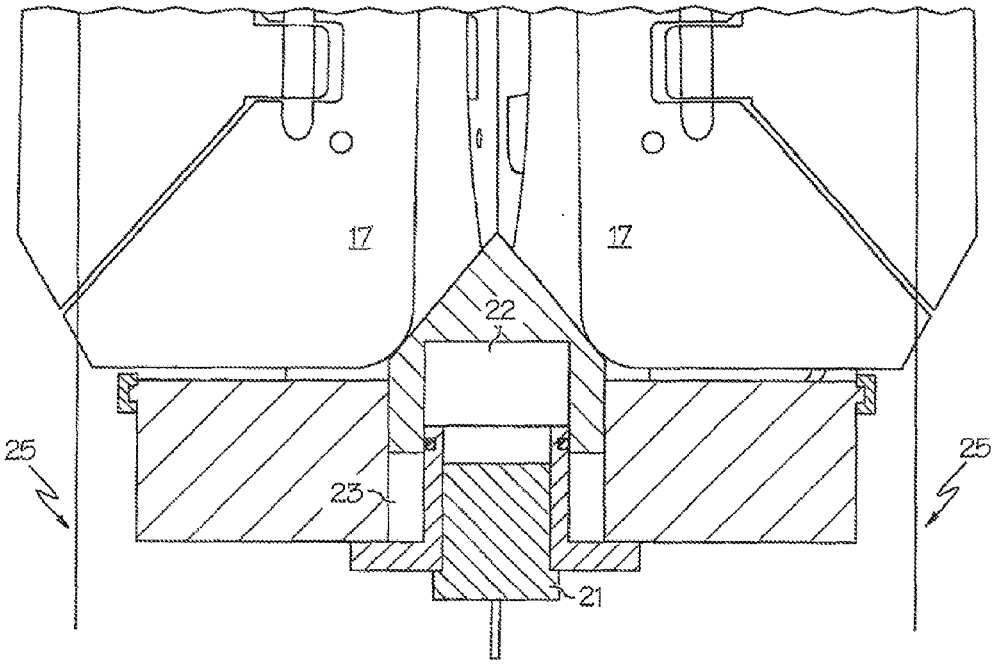

With reference now to FIG. 2A, there is illustrated a seal-breaching element within projectile 10 from FIG. 1A, in accordance with a preferred embodiment of the present invention. As shown, a seal-breaching element, which is located towards rocket motor 16 of projectile 10, includes a hot gas generator 21, a gas chamber 22 and a piston wedge 23. Preferably, hot gas generator 21 can be a pyrotechnic device or other suitable devices for rapidly generating an appropriate volume of hot gas. After projectile 10 has been launched from a launch platform, hot gas generator 21 generates a surge of hot gas within gas chamber 22. The hot air within gas chamber 22 then drives piston wedge 23 between a set of folded fins 17, thereby forcing fins 17 to extend outward to break through an environmental seal 25 surrounding projectile 10. As a result, fins 17 are partially deployed, as shown in FIG. 2B.

After environmental seal 25 has been broken by fins 17, centripetal force from the spinning of projectile 10 should be able to complete the deployment of fins 17. The spin rate of projectile 10 is dependent upon the launch platform of projectile 10. For example, if projectile 10 is launched from a slow moving helicopter, the spin rate of projectile 10 from the launch tends to be relatively high, and the centripetal force generated from the relatively high spin rate of projectile 10 can complete the deployment of fins 17 on their own. As another example, if projectile 10 is launched from a fast moving jet, the spin rate of projectile 10 from the launch tends to be relatively slow, and the centripetal force generated from the relatively slow spin rate of projectile 10 may not be able to complete the deployment of fins 17 on their own. Thus, in conjunction with the centripetal force, a control surface actuation element is utilized to assist fins 17 to complete their deployment.

Figure 3A:
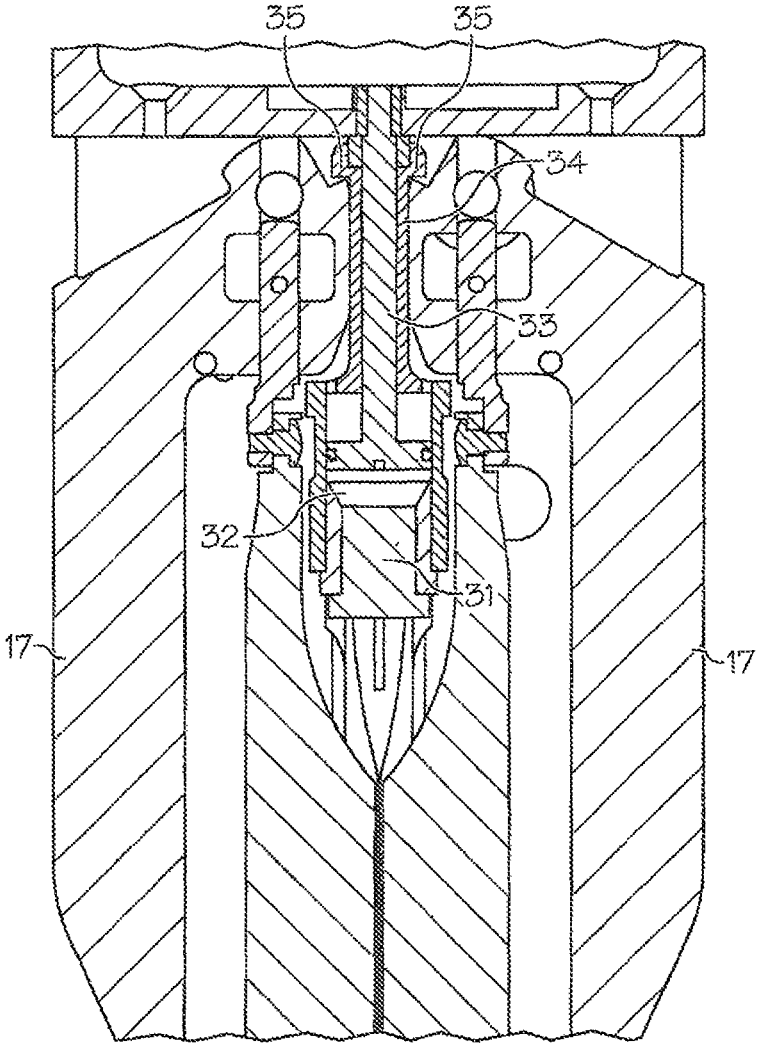
FIG. 3A-3B show a control surface actuation element of the projectile from FIG. 1A, in accordance with a preferred embodiment of the present invention.

Referring now to FIG. 3A, there is illustrated a control surface actuation element within projectile 10 from FIG. 1A, in accordance with a preferred embodiment of the present invention. As shown, a control surface actuation element, which is located towards war head 14 of projectile 10, includes a hot gas generator 31, a gas chamber 32, an axially fixed piston 33 and a moveable barrel 34. Preferably, hot gas generator 31 can be a pyrotechnic device or other suitable devices for rapidly generating an appropriate volume of hot gas. Alter environmental seal 25 has been breached by fins 17 (as shown in FIG. 2B), hot gas generator 31 then generates a surge of hot gas within gas chamber 32. The hot air within gas chamber 32 then linearly displaces axially fixed piston 33 and barrel 34. The linear motion of axially fixed piston 33 and barrel 34 is then translated to a rotational force to a lever arm attached to each of fins 17.

Figure 3B:
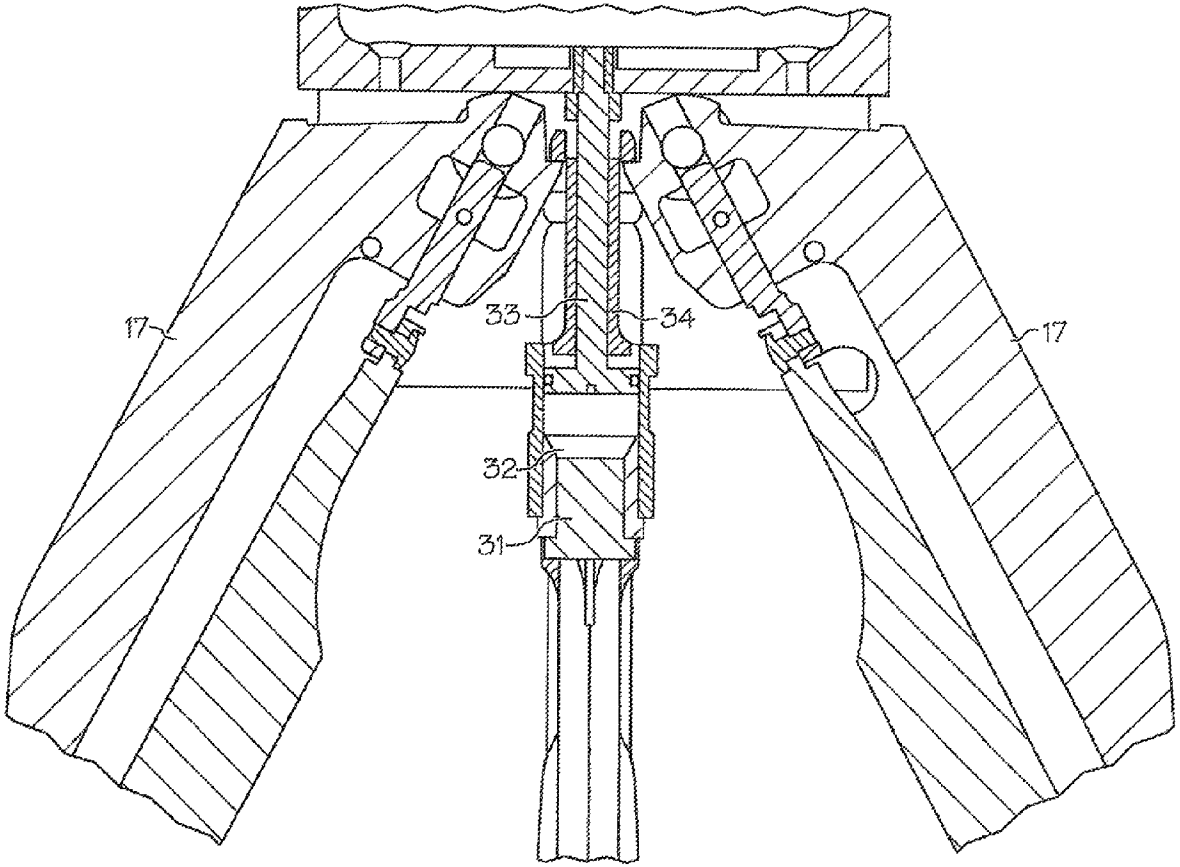

Specifically, control surface interfaces 35 are located between barrel 34 and fins 17. Fins 17 are fully deployed following the rotation of control surface interfaces 35. As a result, the control surface actuation element works to supplement the centripetal force from the spinning of projectile 10 for ensuring full deployment of fins 17, as shown in FIG. 3B.

While any functional combination of placement locations is acceptable, it is contemplated that, the seal-breaching element is preferably positioned at the trailing edge or free end of folded fins 17 and the control surface actuation element is preferably positioned at the leading edge or root of folded fins 17. In an exemplary embodiment, the seal-breaching element would be activated at a user-defined time following the launch of a projectile. After the activation of the seal-breaching element, the control surface actuation element will be activated in order to ensure a complete deployment of fins 17 in the event that centripetal force alone is not sufficient to fully deploy fins 17.

It is contemplated that a variable delay ignition system may be used to dynamically determine an appropriate time delay between the activation of seal-breaching element and the activation of control surface actuation element based on various environmental and behavioral characteristics relevant to a specific projectile. However, a fixed time delay system can be also utilized.

As has been described, the present invention provides an improved apparatus for deploying control surfaces of a projectile. The hot gas based system of the present invention can effectively deploy control surfaces through environmental seals of any thickness, in any environmental condition, and for projectiles of any diameter.

While the invention has been particularly shown and described with reference to a preferred embodiment, it will be understood by those skilled in the art that various changes in form and detail may be made therein without departing from the spirit and scope of the invention.

What is claimed is:

1. An apparatus for deploying stowed control surfaces of a projectile, said apparatus comprising:

an environmental seal covering said projectile;

a first and second gas chambers;

a first hot gas generator for discharging a surge of hot gas into said first gas chamber;

a piston wedge, in response to said surge of hot gas being discharged into said first gas chamber, displaces at least two control surfaces to break said environmental seal to partially deploy said at least two control surfaces;

a second hot gas generator for discharging a surge of hot gas into said second gas chamber; and a set of control surface interfaces, in response to said surge of hot gas being discharged into said second gas chamber, forces said at least two control surfaces to deploy completely.

2. The apparatus of claim 1, wherein said second hot gas generator is activated after an activation of said first hot gas generator.

3. The apparatus of claim 2, wherein said second hot gas generator is activated after a predetermined time delay from said activation of said first hot gas generator.

4. The apparatus of claim 1, wherein said apparatus further includes an axially fixed piston and barrel, wherein said surge of hot gas in said second gas chamber linearly displaces said axially fixed piston and barrel.

5. The apparatus of claim 4, wherein said set of control surface interfaces is located between said barrel and said plurality of control surfaces, wherein said set of control surface interfaces translate the linear motion of said barrel to a rotation motion to force said at least two control surfaces to deploy completely.

6. The apparatus of claim 1, wherein said piston wedge includes a triangular-shape head.

7. The apparatus of claim 6, wherein said triangular-shape head of said piston wedge drives between said at least two control surfaces to displace said at least two control surfaces to break said environmental seal to partially deploy said at least two control surfaces.

* * * * *